US007946922B2

(12) United States Patent
Yin

(10) Patent No.: US 7,946,922 B2
(45) Date of Patent: May 24, 2011

(54) ADVERTISING FUNDED GAMING SYSTEM

(76) Inventor: Howard Hung Yin, Arcadia, CA (US)

( * ) Notice: Subject to any disclaimer, the term of this patent is extended or adjusted under 35 U.S.C. 154(b) by 719 days.

(21) Appl. No.: 12/074,617

(22) Filed: Mar. 5, 2008

(65) Prior Publication Data

US 2009/0227377 A1 Sep. 10, 2009

(51) Int. Cl.
*A63F 9/24* (2006.01)

(52) U.S. Cl. ..... 463/42

(58) Field of Classification Search ..... 463/42
See application file for complete search history.

(56) References Cited

U.S. PATENT DOCUMENTS

| | | | |
|---|---|---|---|
| 5,960,411 | A | 9/1999 | Hartman et al. |
| 6,029,141 | A | 2/2000 | Bezos et al. |
| 6,186,893 | B1 | 2/2001 | Walker et al. |
| 6,251,017 | B1 | 6/2001 | Leason et al. |
| 6,379,251 | B1 | 4/2002 | Auxier et al. |
| 6,390,917 | B1 | 5/2002 | Walker et al. |
| 6,595,859 | B2 | 7/2003 | Lynn |
| 6,901,375 | B2 | 5/2005 | Fernandez |
| 6,928,414 | B1 | 8/2005 | Kim |
| 6,979,000 | B1 | 12/2005 | Vahala |
| 7,016,861 | B2 | 3/2006 | Mothwurf |
| 7,025,674 | B2 | 4/2006 | Adams et al. |
| 7,054,831 | B2 | 5/2006 | Koenig |
| 7,083,518 | B2 | 8/2006 | Rowe |
| 7,085,733 | B2 | 8/2006 | Ebisawa |
| 7,094,149 | B2 | 8/2006 | Walker et al. |
| 7,259,747 | B2 | 8/2007 | Bell |
| 7,658,672 | B1 * | 2/2010 | Wolf et al. ..... 463/13 |
| 2001/0034635 | A1 | 10/2001 | Winters |
| 2002/0010025 | A1 | 1/2002 | Kelly et al. |
| 2002/0094870 | A1 | 7/2002 | Murray |
| 2002/0112233 | A1 | 8/2002 | Cantu Bonilla et al. |
| 2003/0088455 | A1 | 5/2003 | Gruber et al. |
| 2004/0224773 | A1 | 11/2004 | Sham |
| 2004/0248639 | A1 | 12/2004 | Slomiany |
| 2005/0027595 | A1 | 2/2005 | Ha et al. |
| 2005/0037846 | A1 | 2/2005 | Anokhin |
| 2005/0216346 | A1 | 9/2005 | Kusumoto et al. |
| 2005/0258596 | A1 | 11/2005 | Such |
| 2006/0063587 | A1 | 3/2006 | Manzo |
| 2006/0247037 | A1 | 11/2006 | Park |
| 2006/0259361 | A1 | 11/2006 | Barhydt et al. |

(Continued)

FOREIGN PATENT DOCUMENTS

| | | |
|---|---|---|
| WO | WO 0176709 | 1/2001 |
| WO | WO 0169512 | 9/2001 |

*Primary Examiner* — Pierre E Elisca
(74) *Attorney, Agent, or Firm* — Cislo & Thomas, LLP

(57) ABSTRACT

A gaming where a hosts search for and select particular events they desire to manage; where players can wager on specific events with potentially no financial loss; and where vendors can engage in interactive advertising to increase sales. The host manages the game by setting up the odds and establishing other rules of play. Where hosts are also vendors, they may offer prizes in exchange for credits from the players. Players place their wagers on a particular outcome of the event. Both the host and the player may gain additional credits for clicking or viewing an advertisement displayed on the webpage. If the desire outcome occurs, the player's wager is accounted for by the host and the credits can be applied to the purchase of prizes offered by the host. Those who lose may receive communications from the vendor, with permission from the operator of the website, to offer its goods or services.

27 Claims, 12 Drawing Sheets

U.S. PATENT DOCUMENTS

| | | | | |
|---|---|---|---|---|
| 2007/0026916 | A1 | 2/2007 | Juds et al. | |
| 2007/0071208 | A1 | 3/2007 | Morris | |
| 2007/0077981 | A1 | 4/2007 | Hungate et al. | |
| 2007/0079326 | A1 | 4/2007 | Datta et al. | |
| 2007/0130011 | A1 | 6/2007 | Postrel | |
| 2007/0174121 | A1 | 7/2007 | Plotkin et al. | |
| 2008/0020834 | A1* | 1/2008 | Breckner et al. | 463/27 |
| 2009/0036202 | A1* | 2/2009 | Baerlocher et al. | 463/25 |
| 2009/0124384 | A1* | 5/2009 | Smith et al. | 463/42 |
| 2010/0124967 | A1* | 5/2010 | Lutnick et al. | 463/17 |

* cited by examiner

Player 1: If we can get 10 players to bet on your page will you change the odds to 10:1

Player 2: I'm in

Player 3: I'll bet

Host: You have 1 hour to get 10 players to agree.

700

FIG. 7

ADVERTISING FUNDED GAMING SYSTEM

TECHNICAL FIELD

This invention relates to online gaming.

BACKGROUND ART

Online gaming has gained great popularity with the advent of the internet. Now, those who enjoy gambling and gaming can do so in the leisure of their own homes as many of the popular casino games are available online.

Vendors have also taken advantage of online advertising by purchasing various advertising space on the multitude of websites available including gaming websites. To increase the interest of the advertisements, some websites incorporate the advertisements into the games. Some vendors also provide additional credits to players for viewing their advertisements during the game.

A disadvantage of the gambling websites is that players tend to lose money. As they lose money, they are less likely to make purchases from the vendors. Thus, what is still needed is a gaming website where players continue to have fun, where vendors can be interactive, and where little or no money is lost.

DISCLOSURE OF INVENTION

The present invention is directed towards a gaming website where players can wager on specific events with potentially no financial loss and where vendors can engage in interactive advertising to increase sales. The gaming website allows individuals or vendors to act as a host and manage the wagering of credits on a particular event. The host sets up the odds and the rules of the game. Players place their wagers on a particular outcome of an event or multiple events. Both the host and the player may gain additional credits for a player clicking or viewing an advertisement displayed on the webpage. When the event ends, the player's wager is accounted for and only credits won can be applied to the purchase of prizes offered by the host. In some embodiments, the player or players may counter-offer or negotiate the price of the prize offered by the host or vendor. Those who lose may receive communications from the vendor, with permission from the operator of the website, to offer its goods or services.

It is an object of the current invention to provide a website where a host can manage the playing of the game.

It is another object of the current invention where the host determines the odds of the outcome of an event and sets the rules for playing the game.

It is another object of the current invention where the player or players can negotiate with the host to determine the odds of the outcome of an event or events.

It is another object of the current invention to provide a website where players can play for free by earning free credits for logging in or clicking on advertisements.

It is another object of the current invention for the players to use the credits towards the purchase of a prize sold by the host.

It is another object of the current invention to allow the host/vendor to provide additional credits to the players with the approval of the operator for playing on the host's table, wherein the winning credits can only be redeemed with the prizes sold by the host/vendor.

It is another object of the current invention to allow the host to organize a private club with only selected players involved.

It is another object of the current invention to allow vendors to sponsor and advertise on the website.

BRIEF DESCRIPTION OF DRAWINGS

FIG. 7 is an embodiment of the public communications page.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention is directed towards a gaming or gambling website accessed by a network of computers and/or other electronic devices, where a host selects the games to manage on the website, determines the odds of the outcome of an event or negotiates with player or players as to the odds of the event or events, establishes the rules by which the games are to be played, and controls the advertisements that are to be displayed on his game page; a player plays the games and receives credits for winning the game or for clicking on the advertisements, wherein the credits may be redeemable for prizes; and vendors (sellers of goods and/or services) sponsor the website and provides the revenue for the website in exchange for the advertising. In some embodiments, the revenue may be based on the number of clicks of the advertiser's ad banners.

Figure 1:
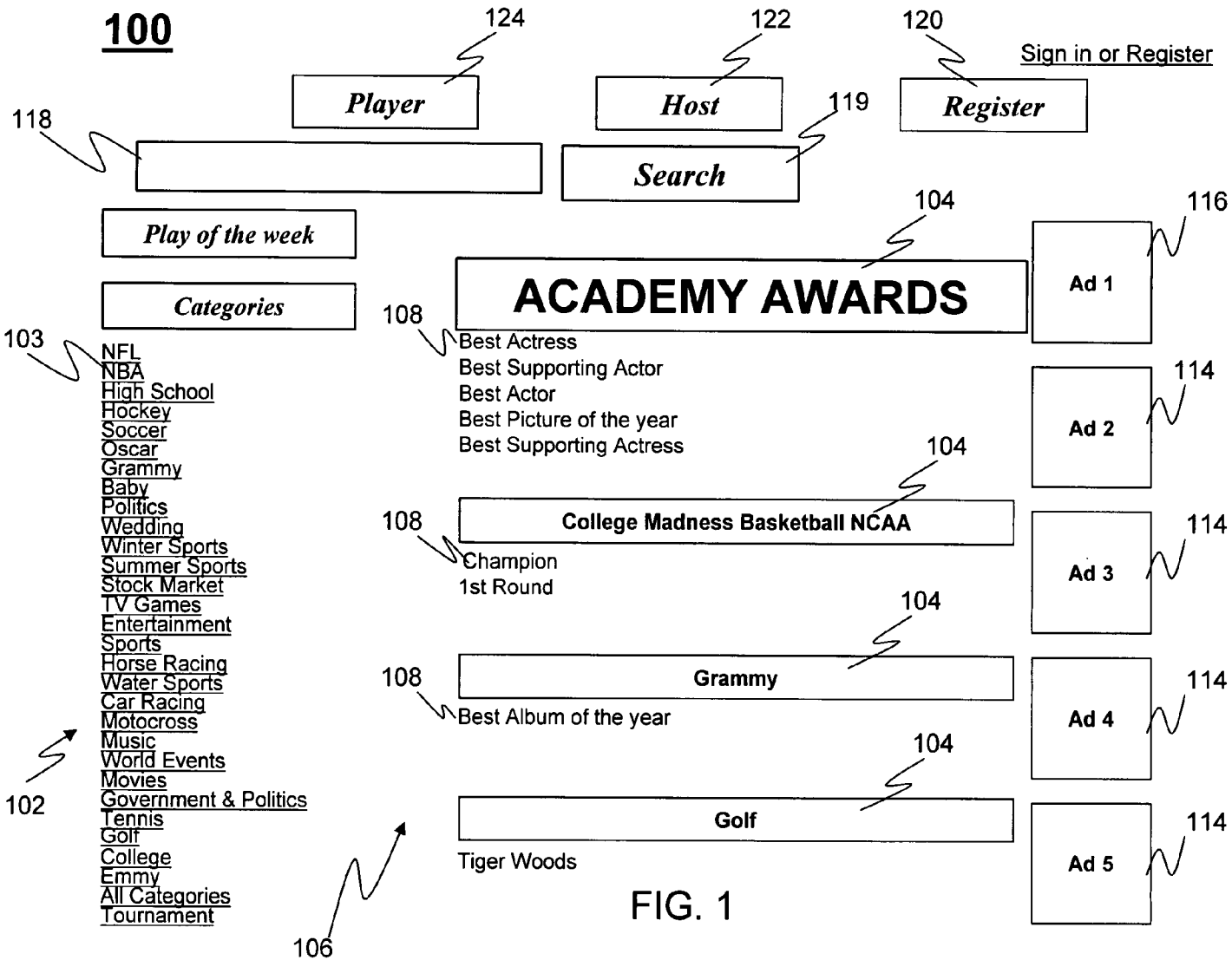
FIG. 1 is an embodiment of a home page of the current invention.

As shown in FIG. 1, the website main page or homepage 100 displays the gaming opportunities of the website, including a list of categories 102 of the types of events to manage or play, a display of sample events 106 that are available to manage or play, and methods of searching for particular events. A visitor visiting the website homepage 100 can quickly see the types of games available and determine whether to explore the website further.

To enter, navigate through and utilize the website a user must establish communications with the server or operator of the website via a computer or other electronic device with internet or web browsing capability, such as a mobile phone, smart phones, portable digital assistants, handheld computers, and other handheld devices or the like. Once communications with the website is established, a visitor must first register by clicking a register button 120. Registration entails providing the typical information gathered when registering on a website, such as identification, contact information, password, secret code, and the like. Registration also includes providing information regarding the registrant's interests, hobbies, profession, or any other information regarding the registrant's purpose for playing on the website. The registration information is stored in a database and the information is used to present games that may be of interest to the player or host after logging in. In some embodiments, an alert service may be activated to send a player information, via email, when a particular event is being hosted.

Once an individual registers, the individual may sign in as a host by clicking on the host button 122, to manage or host a game, or as a player by clicking on a player button 124, to play a game. The host may be anybody that manages a game. In some embodiments, the host may also be a vendor or an advertiser.

Logging in as a host takes the host to a hosts main page or hosts homepage 200A, as shown in FIG. 2. A host is automatically credited a predetermined amount of credits upon logging in. The host's credits 212 are displayed to inform the host of his current balance. The host may receive the free credit only one time per day per login. The credits are used as payouts to players who win the game the host is managing. The host may also borrow money or credits from the operator. If the host elects to borrow credits, the host will be required to provide sufficient information to conduct a credit check or to show the host's credit worthiness.

From the hosts homepage 200A, the host can select to setup a game by clicking on a game setup button 201 or manage a game by clicking on a host game button 203. Once the host has selected whether to set up a game or manage a game, he can search for the event that will serve as the basis for his game.

The hosts homepage 200A is designed to allow a host to find and select a particular events to setup or manage as well as providing a means of funding the game. Upon logging in, the types of events displayed in the display of events 106 may be determined automatically based on the information provided during registration. Thus, no searching or browsing would be required.

Another method of finding an event to host comprises providing a list of categories 102 of the types of events that the host may be interested in managing. Selecting a specific category 103 may display subcategories, where available, or provide a display of events 106, including subevents 108, if any.

Another method of finding events is to use a search field 118 to conduct a search for specific types of events. The search field 118 may be a keystroke entry field, a drop down window, or any other type of search techniques known in the art. Submitting a search entry through the search field 118 may display a list of categories 102 or a display of events 106, including subevents, meeting the search criteria.

If the category or event is not presented by the website, the host may contact the operator to request such a category or event. The category 103 may be any types of events, such as sports, politics, television, financial. Each category 103 may have a sub-category; each sub-category may have further divisions, until a specific event 104 is presented. For example, a category of sports may be subdivided into professional versus college and/or different types of sporting events, such as basketball, baseball, football, and so on. The specific event may be the NBA finals, the World Series, or the Super Bowl. Sub-events that may also be wagered upon are events within the event that have more than one outcome. Some examples of sub-events within the events of the NBA finals include, which team will score the first point, which player will score the first point, which player will foul out first, and so on.

Figure 2A:
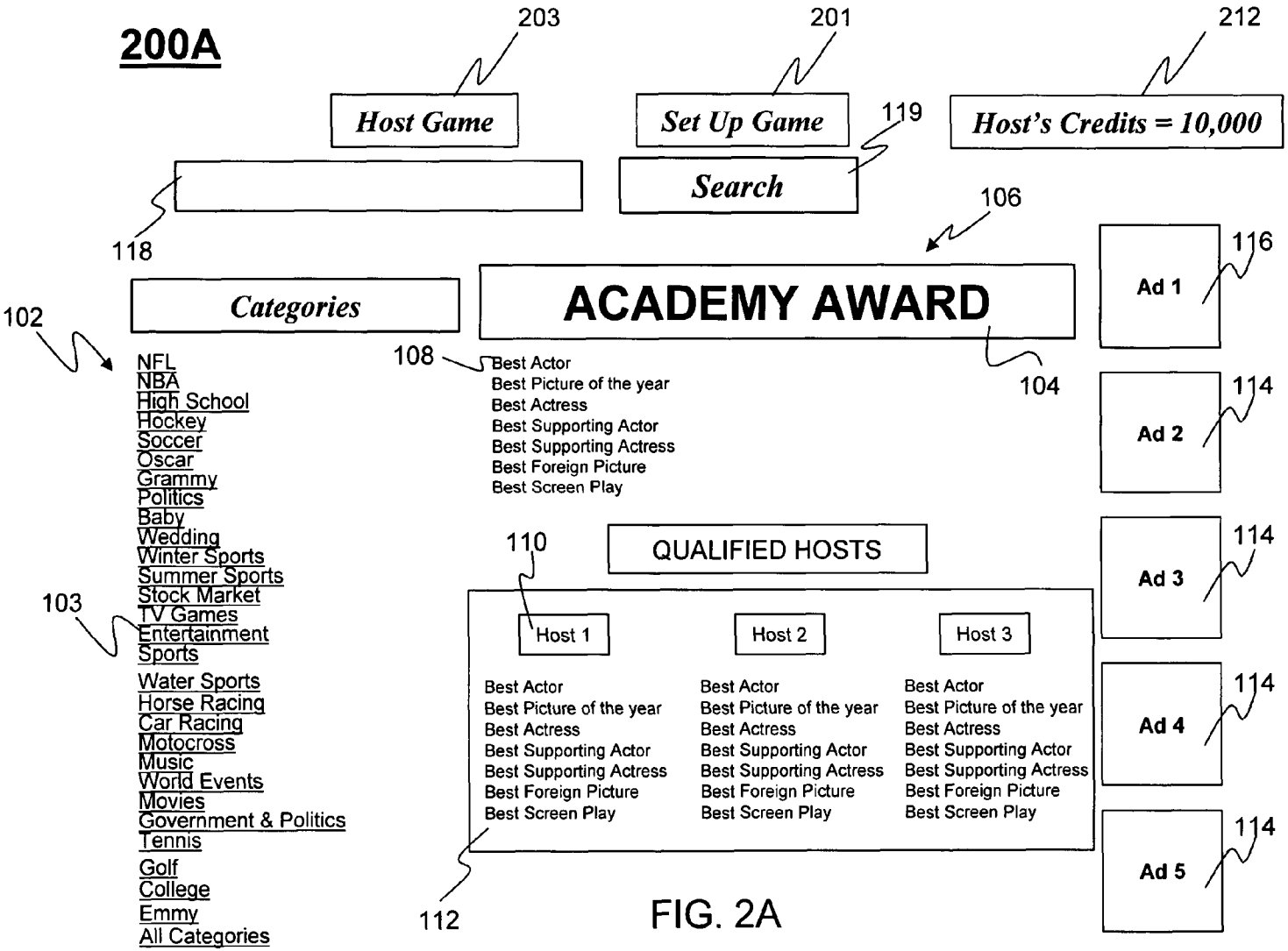
FIG. 2A is an embodiment of a hosts homepage.
Figure 2B:
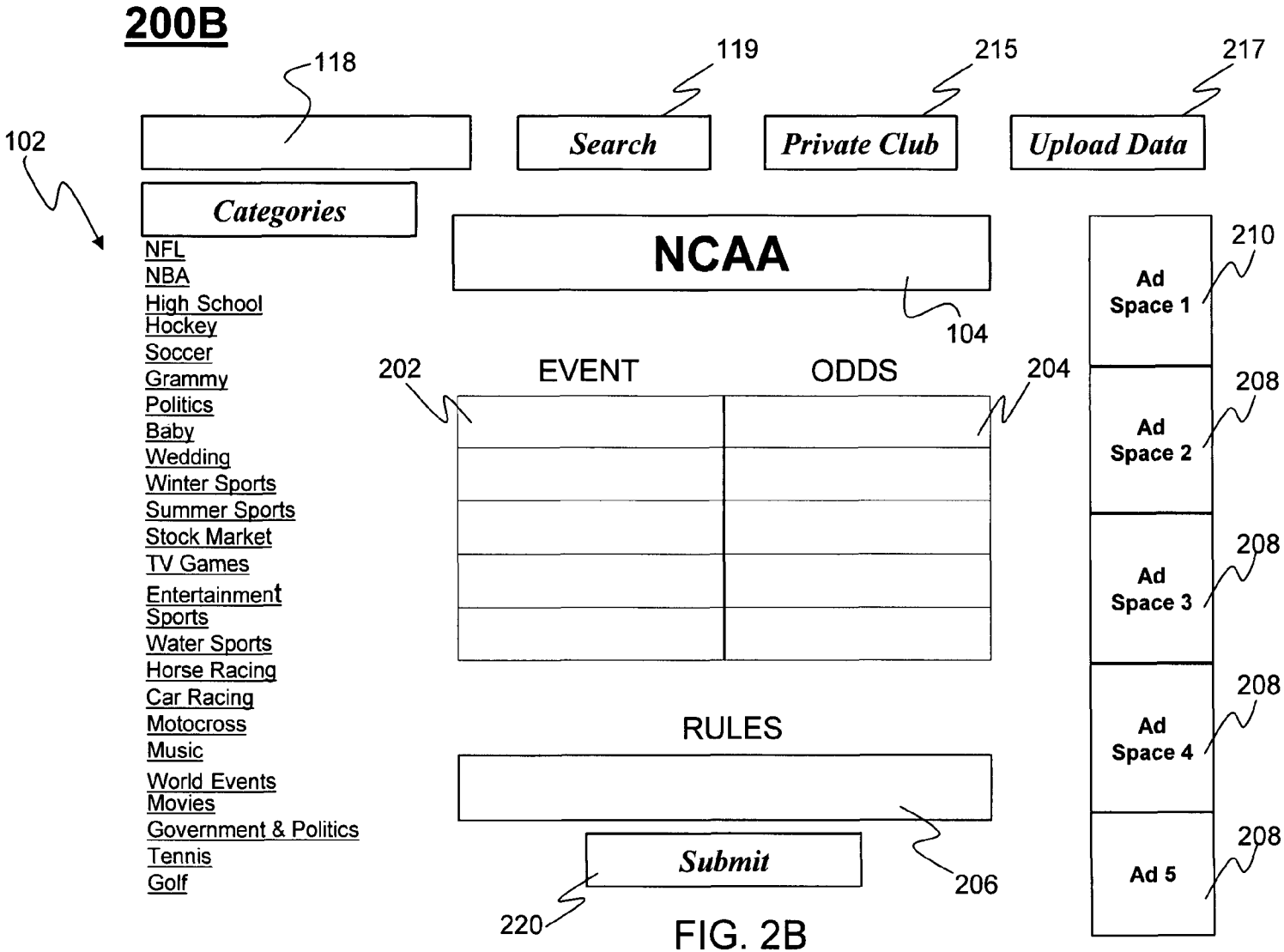
FIG. 2B is an embodiment of a game setup page.

Selecting a specific event 104 takes the host to a game setup page 200B where the host can establish a game based on the event 104, as shown in FIG. 2B. A game comprises an event 104, and optionally subevents 108; odds 503 that the event will have a particular outcome; and a wager 501 that the event will have an expected outcome. The event 104 may be standard casino games, such as blackjack, poker, roulette, or the like. The event 104 may be of the type in which wagering is common such as sporting events, horse racing or the like. The event may also be any other type of event or game of chance, including those that normally do not involve wagering. For example, the event 104 may be award shows, such as the Academy Awards, Grammy, Emmy or the like; elections, such as the presidential election; the stock market; and even reality shows. The, players may be playing against each other, as in a tournament, or against the host. There is no limit to what event a host may offer as a game. For example, the player may be wagering on whether or not it will rain the next day. In general, an event is any circumstance, situation, or happening in which two or more outcomes are possible. A subevent is an event occurring within an event. Thus reference to events encompasses subevents.

On the game setup page 200B the host establishes the odds of winning an event in the odds entry field 204 for each predetermined event 104 and sub-event (if available). As such, unlike other games in which the odds are determined objectively by probability, professional judgments, or voting of the masses (for example, odds of a particular team winning a sporting event based on statistical and professional analysis and voting trends), the host has sole control as to the odds. Allowing the host to control the odds allows different hosts managing a similar game to compete with each other to entice the players to play their game. Thus, in a sense, the host is also gambling. The odds selected by the host are generally at the host's discretion. When the host borrows money from the operator; however, the operator may require the operator's approval for the odds that are established by the host.

In some embodiments, the odds may be negotiated between the host and the player or players. Each individual player may have its own odds. Alternatively, players may get together in a forum and collectively bargain with the host for better odds.

The game setup page 200B also allows the host to establish the rules of the game in the rules entry field 206. Some rules the host may take into consideration include when the last wager may be placed, whether the amount of the wager may be changed, the minimum and maximum wager, whether the player can change his position on the selected outcome of the game, how long the game lasts, how many rounds of play there will be, whether a wager can be placed for separate rounds, whether the host receives a commission on the player's winnings, and so on. In addition, standards may be set up for a player to meet in order to play a particular host's games. Standards may be established by the operator. For example, players engaged in numerous games and placing high wagers may achieve the highest standard (e.g. "Platinum"). Players engaged in a modest amount games with moderate wagers may achieve the middle standard (e.g. "Gold"). Players who play infrequently and place low wagers may achieve a low standard (e.g. "Silver"). Host's may require that a player achieve a certain standard level before playing the host's games.

Figure 2C:
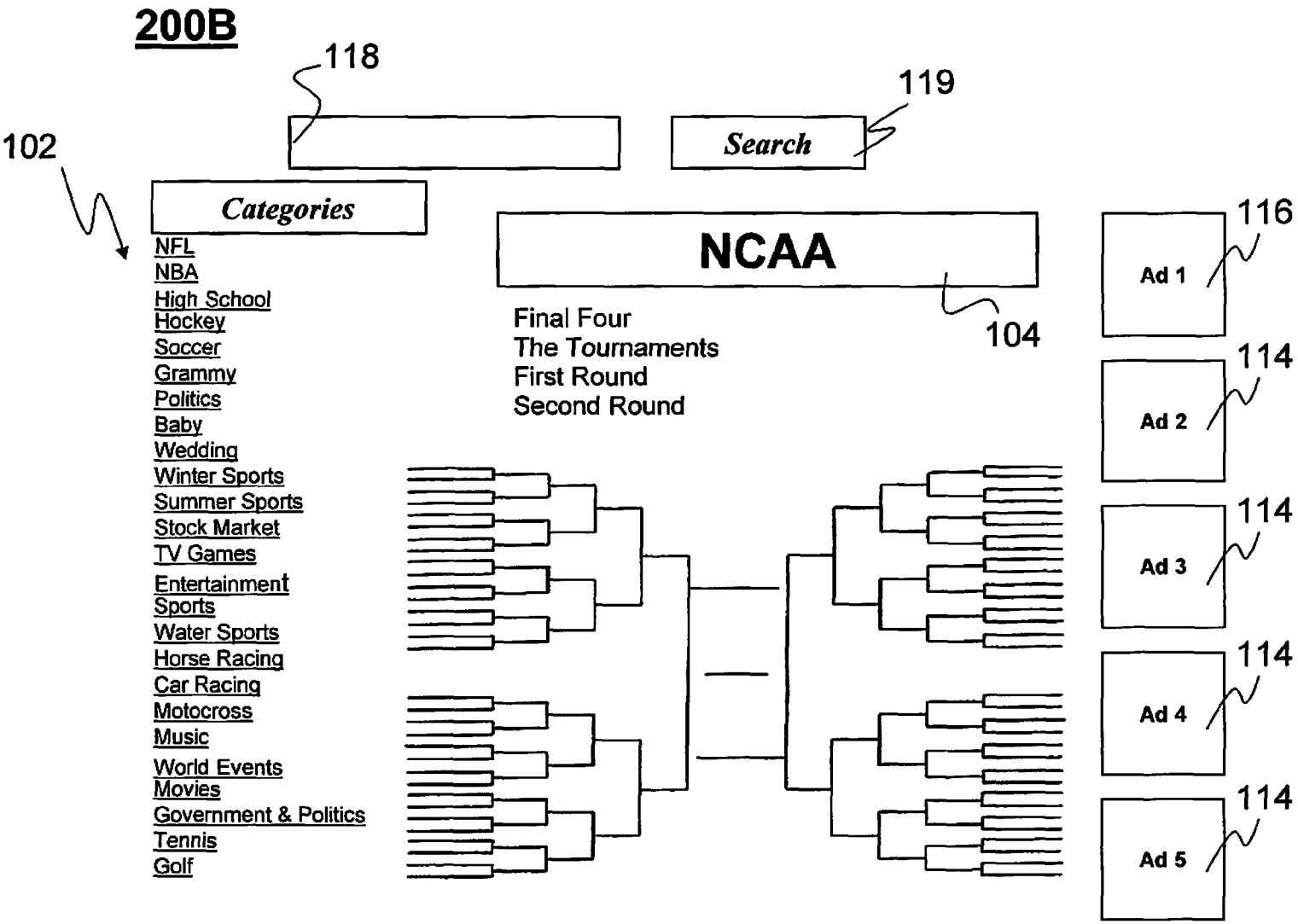
FIG. 2C is another embodiment of a game setup page.

On the game setup page 200B, an event entry field 202 may be provided for the host to design how the event 104 will be displayed on the game page 500 for a player. For example, the event 104 and the odds 503 may be presented as word text only, pictures, photos, tables, graphs, charts, animations, videos, audios, audiovisuals or the like, or any combination thereof as shown in FIG. 2C. In some embodiments, the operator may set up how the event 104 will be displayed. In some embodiments, an upload data button may be presented for the host to upload the text, pictures, photos, tables, graphs, charts, animations, videos, audios, audiovisuals or the like, or any combination thereof.

The game setup page 200B may also comprise a privacy button or a private club button 215. Clicking on the private club button 215 makes the game page 500 private. Thus, a player desiring to play a privatized game must be qualified to play. The qualifications can be determined by the operator or host. For example, a game page 500 that has been privatized by the host may be password protected, meaning that a password would be required to enter the privatized game page 500. Thus, providing the appropriate password qualifies the player to play the game. The host can distribute the password to select players. In some embodiments, selecting the private club button 215 may provide the host the option of creating an exemption list of players login names that are allowed on the privatized game page 500. Thus, a player is qualified to enter a game page 500 automatically if his login name matches one of the login names on the exemption list, without entering a password. This allows a host to set up and manage a game for players that the host knows rather than opening up the game to strangers. In addition, this may allow a host or operator to preclude underage children from certain games.

The setup page 200B may also comprise an upload data button 217 for the host to upload pictures, videos, or text to display on the game page 500. These pictures or videos may be associated with the event with the proper authorization if necessary. For example, if the game is a horse race, the host may display a live streaming video of the horse race. If the game is a basketball game, the host can display pictures of videos of the game as well as posting scores or other statistics that may constitute subevents on which the players have placed wagers. If the game is a tournament, the host can post a tournament bracket.

During the setup of a game, the host may also select advertisements 114 that will be eventually displayed on the game page 500. The host is provided with a plurality of advertisement spaces 208. One advertisement space is reserved as the host's advertisement space 210. Thus, if the host is also a vendor or an advertiser, the host may put his own advertisement 116 in the host's advertisement space 210. In some embodiments, the operator selects which advertisements 114 it would like to place in the remaining advertisement spaces 208 from a predetermined list of available advertisements. In some embodiments, the host may select which advertisements to place in the remaining advertisement spaces 208. In other embodiments, the advertisers may bid on or purchase one or more of the remaining advertisement spaces 208. In embodiments in which the host or the operator selects the advertisements from a predetermined list of available advertisements, the vendors or advertisers must pay the operator to qualify its advertisement as an available advertisement.

In any case, strategically, it is expected that the advertisements 114, 116 displayed on a game page 500 would be related to the event in some way such that a player playing that game would also have some interest in the advertisements 114, 116 presented on that webpage. For example, advertisements 114, 116 of sporting goods may be placed on events 104 that are sporting events. On the other hand, vendors or advertisers may want to advertise on games that are expected to be extremely popular regardless of whether the advertisement is associated with the event. For example, any advertiser may want to advertise on a game page 500 in which the event is the Academy Awards or the Presidential election simply because many people with diverse interests would be interested in such events.

Another advantage of this gaming website is that even if a particular advertisement was not selected to be advertised on a particular game page 500, that vendor may still advertise on the website for that type of gaming event by being its own host. Then that vendor may advertise on the host's advertisement space 210.

Figure 5:
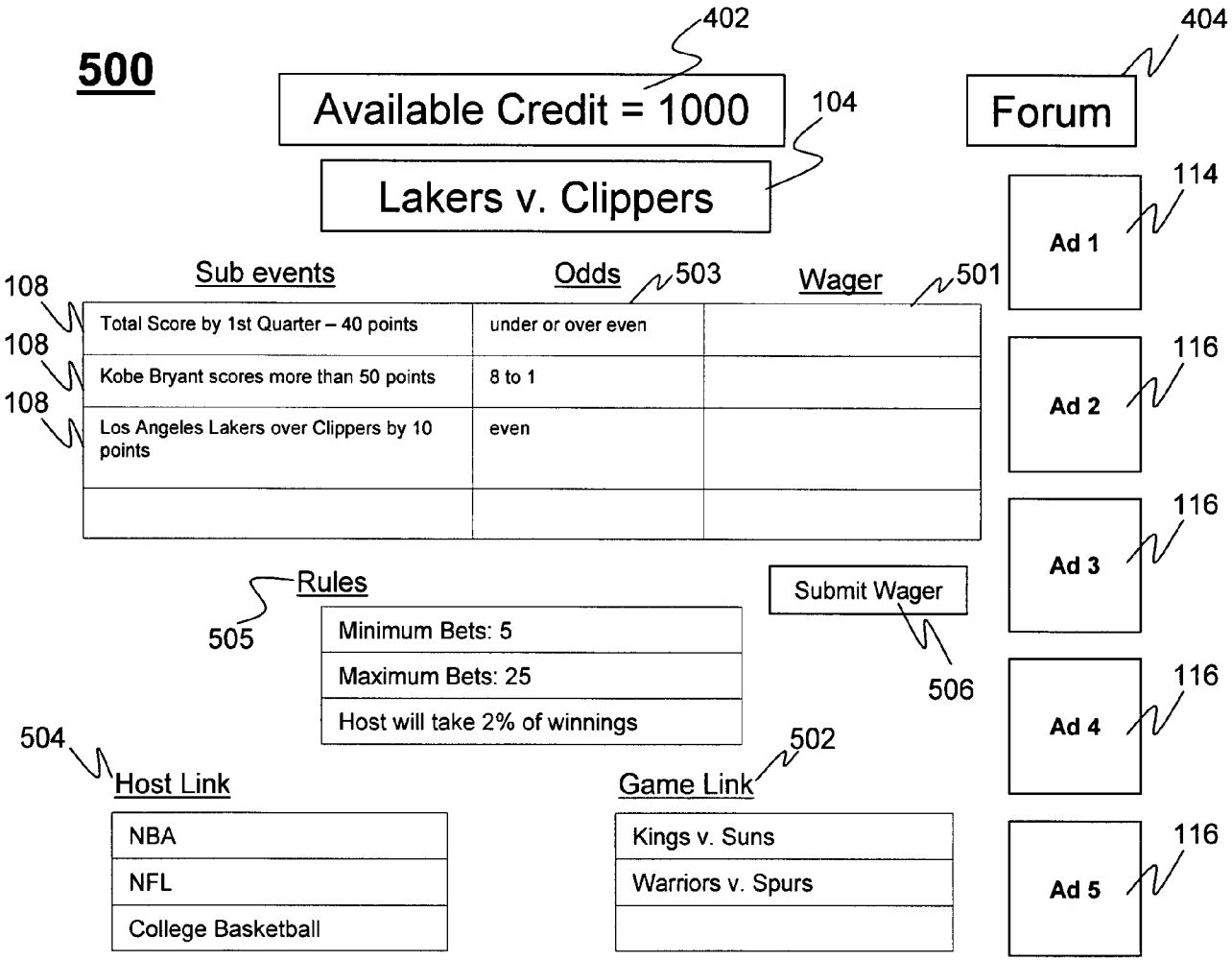
FIG. 5 is an embodiment of a game page.

After setup is complete, the host submits his game setup page 200B by clicking on a submit button 220, which then displays as an interactive game page 500 as shown in FIG. 5. The interactive game page 500 allows players to place wagers as well as click on advertisements.

The host generates credits when players click on the advertisements 114, 116 or when players lose their wagers. Each time a player clicks on the host's advertisement 116, the host receives a predetermine amount of credits. Advertisements 114 in the remaining advertisement spaces 208 generate another predetermined amount of credits for the host that is generally less than the amount received for clicking on the host's advertisement 116. Thus, the host is rewarded for presenting a game page 500 in which players are actively clicking on the advertisements 114, 116. The operator determines the amount of credits the host receives for clicks on the host's advertisement 116 and the remaining advertisements 114.

In some embodiments, the host may update his game page 500 by adding new sub-events to the current event, odds for the new sub-events, and rules for the new sub-events, so long as these additions do not interfere with or influence the odds or outcome of existing events or sub-events that have previously received wagers that have not been accounted for. To add new sub-events to current event, the current game may have to be temporarily suspended or paused to prevent wagering while the game page is being updated with a new sub-event. Clicking on the game set up button 201 may suspend a game and take the host to the game setup page 200B to modify his game.

In some embodiments, once the category 102 is selected the host may be deemed a qualified host for that category based on predetermined requirements made by the operator. For example, hosts with high activity or generating substantial credit may be deemed qualified hosts. A qualified host may have a list of links 112 to its games under the category selected displayed on the hosts homepage. The list of links 112 may display the title of the event. A host can click on the links to immediately provide odds for each event at the game set up page 200B. A player selecting a particular category from the player's homepage 400A sees the qualified hosts and the games they are managing under the selected category. Clicking on the links 112 takes the player to the game page 500 where the player can play that game. Since the qualified hosts are presented on the players homepage 400A, they will have a higher probability that players will select them as the hosts for a particular game.

Once a game ends, the wagers are accounted for based on the odds presented. Losing wagers are credited to the host and winning wagers are paid out from the host's account. The host can then use its credits for the next game or redeem its credits for a prize. A prize may be any goods or services offered by any vendor. In addition, a prize may include coupons, discount coupons, or anything else of value. Alternatively, the credits may be redeemed for operator's credits at a predetermined exchange rate.

Figure 2D:
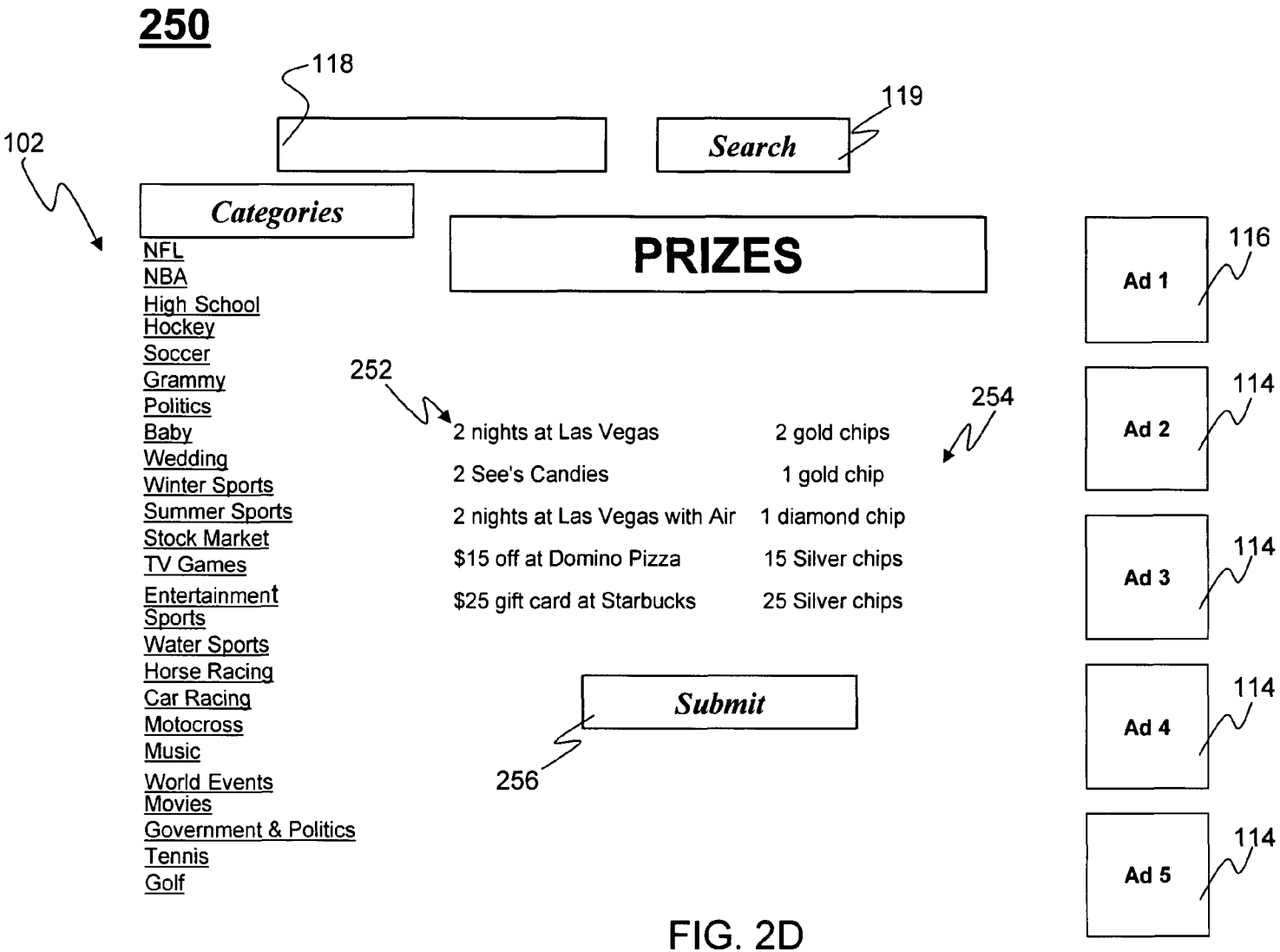
FIG. 2D is an embodiment of the prize page.

If the host happens to be a vendor (seller of goods or services) the host may also offer the players a selection of prizes (in the form of goods or services) for which the players may redeem their credits. The prizes may be presented at the time of the win or the player may be directed to the host's prize page 250, as shown in FIG. 2D, where the player may apply his credit to an online purchase. The prize page 250 displays a list of prizes 252 and the cost 254 for each prize. The player may select a prize and submit its request by clicking the prize submit button 256. The player's credit is then deducted by the amount of the prize.

In some embodiments, the cost of the prize 254 may be negotiated between the player or players and the host. For example, the players homepage 400A may comprise a forum button 404 in which clicking the forum button 404 takes the player to a public communications page 700, such as a chat room, a forum, a bulletin board, or other type of communications page in which a plurality of players can communicate publicly with each other and with the host. The public communications page 700 may be a separate webpage or a pop up window within a current page. At the public communications page 700, the players can come to an agreement as a whole and negotiate with the host on the public communications page 700 for the desired cost of the prize. Once an agreement is reached, the host can input the negotiated cost of the prize on the prize page 250.

In some embodiments, the forum button 404 on the players homepage 400A may display a list of hosts and the games offered by that host. The player can then select the desired host and game offered by the host for which the player wishes to enter the public communications page 700. In some embodiments, the forum button 404 may be placed on the game page 500. Clicking on the forum button 404 on the game page 500 will open a the public communications page 700 specifically for the game selected where the player can communicate with other players playing the same game and/or the host managing the game. The public communications page 700 may be a separate webpage or a pop up window within a current page.

In some embodiments, non-hosting vendors who had advertised on the game page 500 may send communications to players, who ended up losing their wagers, offering the losing players goods or services for purchase. In some instances the offers may be discounted for having played a game. To contact losing players, the vendors must contact the operator. The operator must authorize sending of such communications to the losing players.

Figure 3:
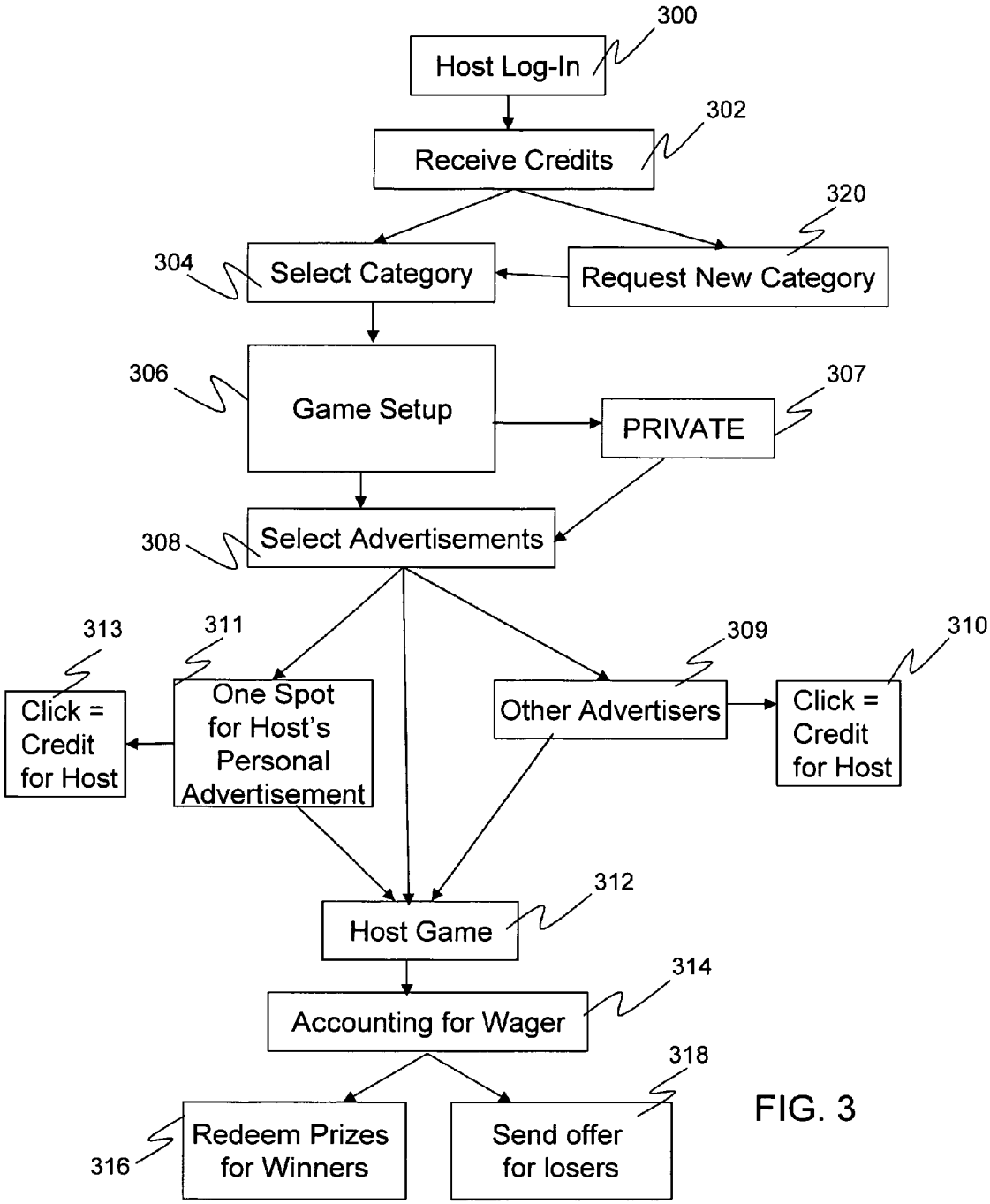
FIG. 3 is a flow diagram of the steps involved in hosting a game.

Thus, as shown in FIG. 3, hosting a game comprises providing a webpage for a host login 300 configured to automatically credit a host's account 302 a first predetermined amount of credits upon a host logging in; offering a selection of games 304 from a predetermined list of games for the host to manage; providing a game setup page in response to the offer of a selection of games 306, the game set up page comprising at least one event to be wagered on, an odds entry field 204 for the host to enter an odds for an outcome of the event, and a rules entry field for the host to enter a rule for the game; allowing the host to privatize the game; offering a selection of advertisements 308 to place in a predetermined number of advertisement spaces; crediting the host a second predetermined number of credits when a general advertisement 309 is clicked on 310 or crediting a third predetermined number of credits when the host's advertisement 311 is clicked on 313; displaying an interactive game page to host 312; receiving a wager for an event on the interactive game page; determining the outcome of the event; accounting for the wager 314 based on the outcome of the event and the odds for the outcome of the event; redeeming credits for prizes for the winners 316 and sending offers to losers 318. In some embodiments, if a particular category is not present, hosts may request addition of new categories 320. Optionally, the game page may be made private 317 during the game setup process so that only qualified players are allowed to play the game.

Figure 4A:
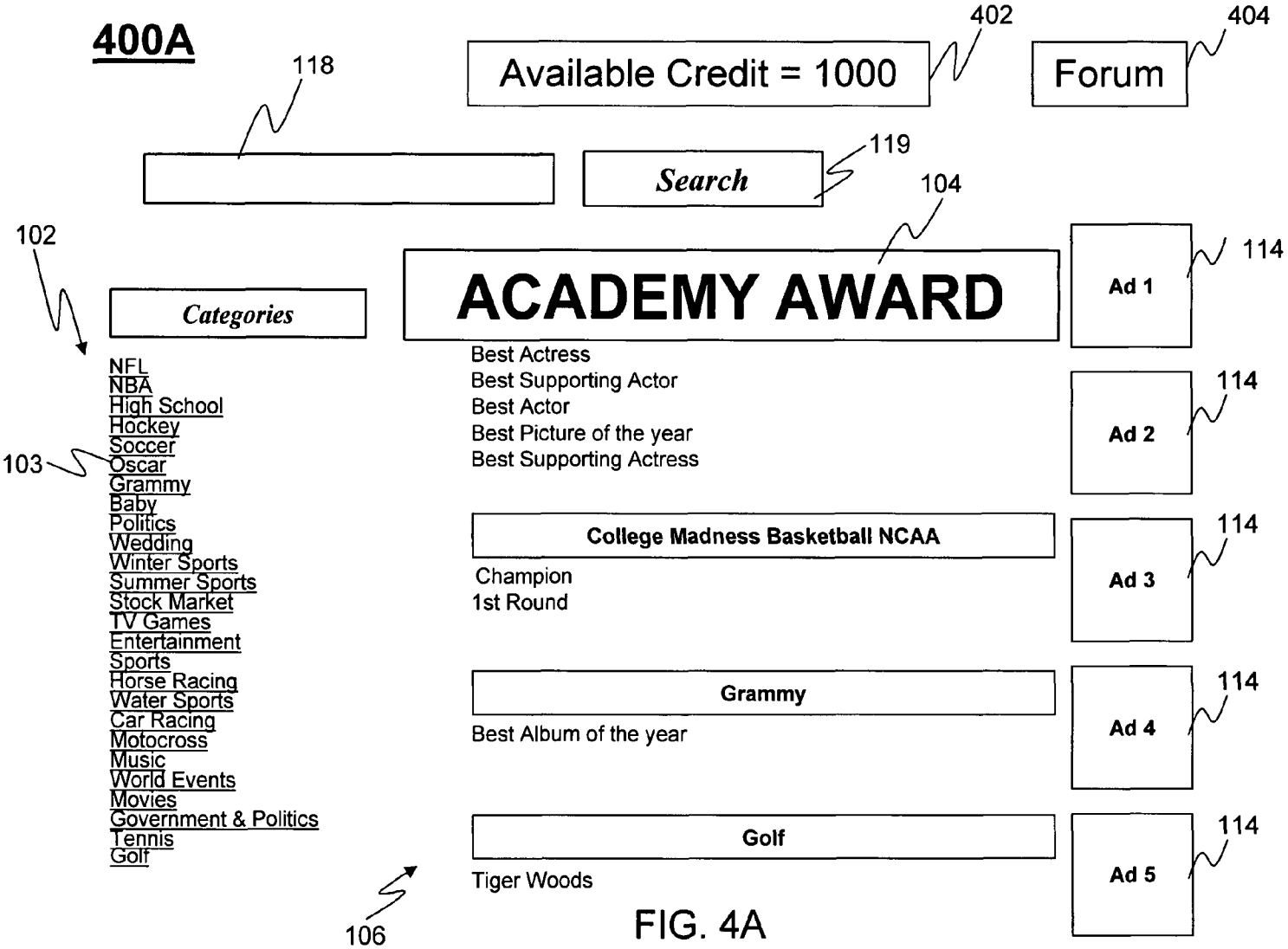
FIG. 4A is an embodiment of a players home page.

From the homepage 100 an individual may login as a player by clicking on a player button 124. Upon initial login, the player is taken to a players homepage 400A, as shown in FIG. 4A, and automatically receives a predetermined amount of free credits to play a game or apply towards a prize. Free credits are offered only one time per day per login per player. The players homepage 400A is analogous to the hosts homepage 200A and comprises the same list of categories 102, a display of events 106, a search field 118 and advertisements 114. Once the player logs in as a player, the website recognizes the player ID and displays the player's available credits in the available credits field 402. From the players homepage 400A the player may find a game to play or acquire more credits by clicking on an advertisements.

A player may find games to play by several different methods. One method is to look at the display of events 106. Prior to selecting a category or conducting a search, the display of events 106 may contain events matching the player's interest based on the player's personal information acquired during registration.

Figure 4B:
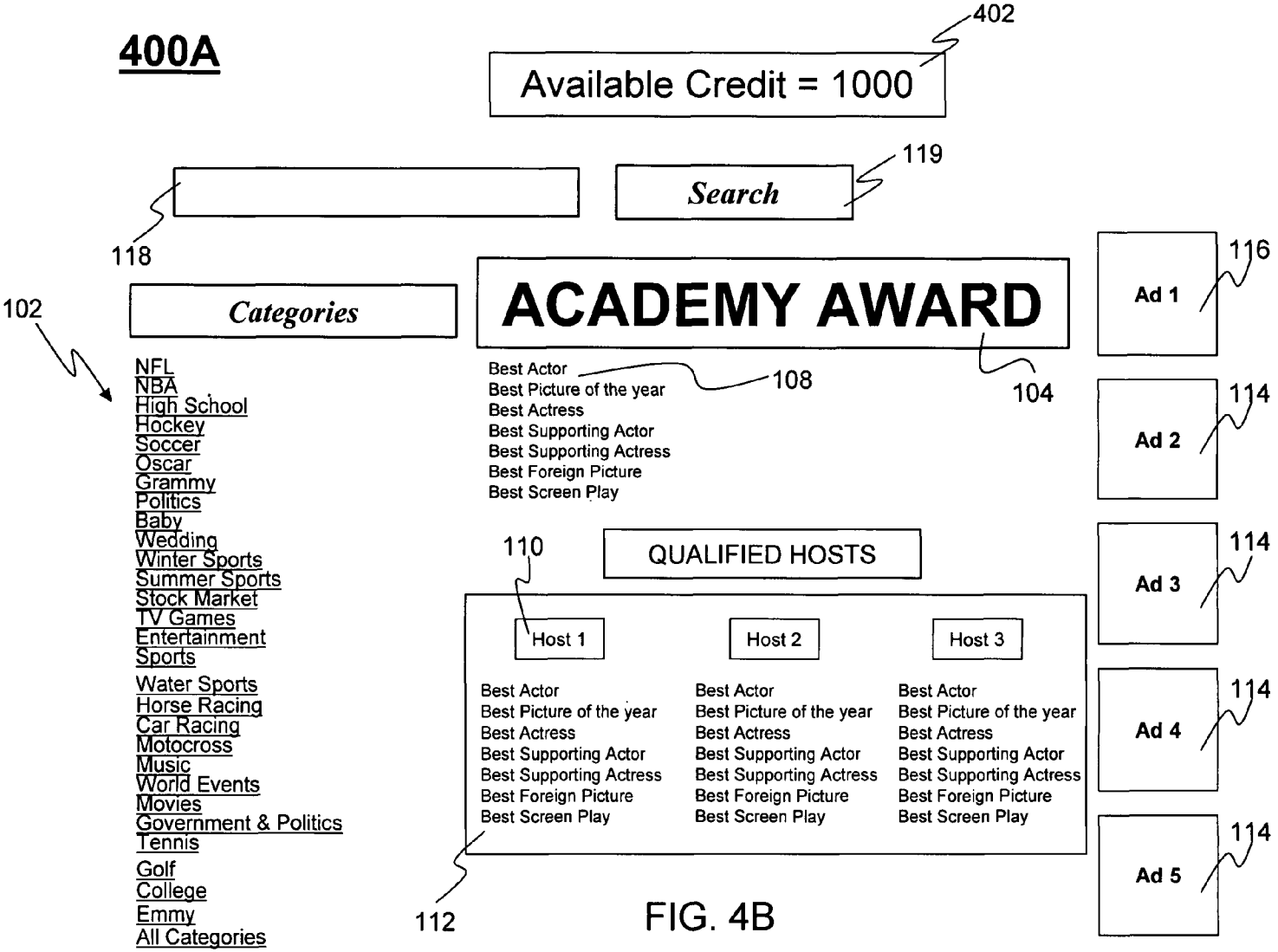
FIG. 4B is another embodiment of a players home page.

A second method for finding games is to browse through the list of categories 102. Selecting a particular category 103 may reveal subcategories or may reveal events 104 within that category. Selecting a category 103 may also display the names of qualified hosts 110 and a qualified host's list of events 112 as shown in FIG. 4B. The player can either select an event 104 from the display of events 106 or select an event 104 from the qualified host's list 112.

A third method of finding games to play is to use the search field 118 and search button 119. The search field 118 may be a keystroke entry field in which the player can type in the type of game, host, vendor, or prize he is interested in. Submitting the search displays a list of events 106 matching the search criteria. Alternatively, the search field 118 may be a drop down window with predetermined search parameters. Selecting particular search parameters displays a list of events matching the search parameters.

For example, searching for a particular event may display a list of hosts managing that event. Searching for a particular host may display all the games that host is managing. Searching for a particular advertisement or vendor or particular prize, good, or service may display all the hosts and events that are using the specified advertiser or advertisement or selling that particular prize, good, or service.

For example, during Valentine's season a player may wish to purchase flowers. The player can conduct a search for games in which flower vendors are advertised, where the flower vendors are the hosts, or where flowers are offered as a prize. The games meeting the search criteria are displayed along with the odds. The player then selects the game of his choice, plays the game, and if he wins, the player receives credits with which he may use to purchase a flower from the host. In this example, the host may be a flower vendor. Vendors whose advertisements have been clicked on will be notified of the user ID who clicked on the advertisement. The vendor may then contact the operator to determine whether the vendor may contact the player for further advertising.

In some embodiments, the player may enter the public communications page 700 for the game meeting the search criteria and rally other players together to negotiate a better price for the flowers or better odds for the game. For example, the player may request a better price for the prize if he can rally enough players to play the host's game. As another example, the player may negotiate different odds for himself should he choose to parlay his wager on multiple event, such as the subevents.

Figure 4C:
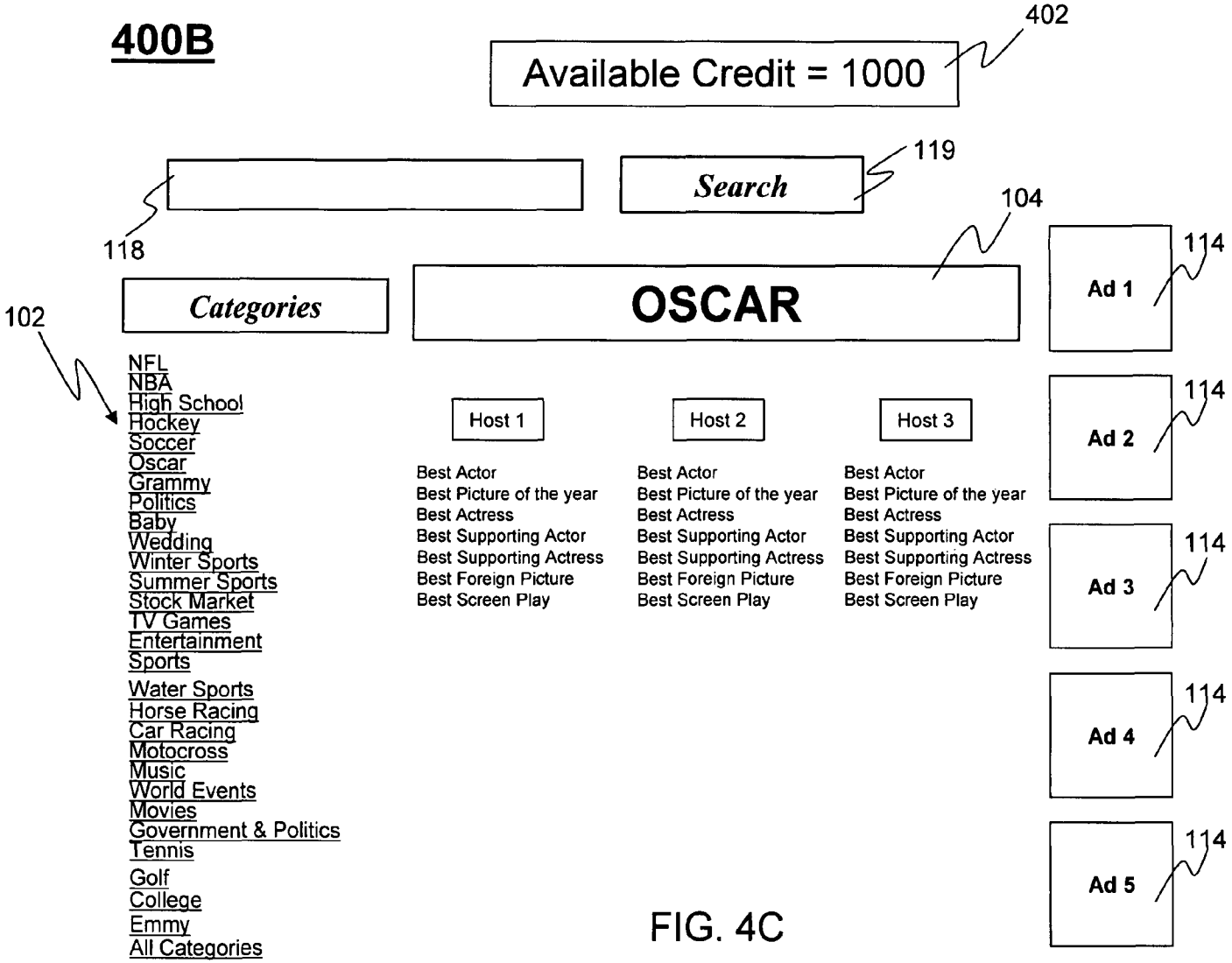
FIG. 4C is another embodiment of a players home page.

Selecting an event 104 from the display of events 106 opens a host selection page 400B displaying a list of hosts managing games for the specified event 104 as shown in FIG. 4C. In some embodiments, the odds 503 may be displayed adjacent to the event 104 or subevent 108 so that the player can see which host is providing the best odds. The player may click on the particular game hosted by a particular host to open the game page 500 of that host. Clicking on an event 104 from the qualified hosts list 112 opens the game page 500 of that host.

Once a player finds the game of his choice, clicking on the game opens an interactive game page 500, as shown in FIG. 5, displaying the game, which includes the event 104 and subevents 108 to be wagered on, their respective odds 503, and the rules of the game 505. The player may enter his wager in the wagering field 501 associated with the event 104 or subevent 108.

In some embodiments, the game may be privatized, requiring the player to qualify to enter the game. In some embodiments, the player may be requested to enter a password to qualify to play the game. In another embodiment, whether the player qualifies may be determined automatically. For example, the host or the operator may predetermine what qualifications the player is required to have in order to play a game. The qualifications could be a login name or age. Upon a player logging in, the operator or the server would automatically know, based on the players login name and personal information collected during registration, whether the player has met the predetermined qualifications.

In some embodiments, upon approval from the operator, the host may offer additional credits to players for visiting his game page 500. The host or the operator may determine specific rules for using the additional credits. For example, the host may restrict the use of the additional credits to his game only. The operator may or may not offer to allow the player to exchange the additional credits for operator credits. The operator may also determine a different exchange rate for the additional credits compared to normal credits that the player entered the game with. Thus, the host may offer promotionals by advertising additional credits during particular seasons.

In some embodiments, a player may be provided with a means for negotiating with the host for better odds. For example, the odds field 503 may be a keystroke entry field initially displaying the odds offered by the host but editable such that the player can delete the host's odds and enter his own odds. Pressing the submit wager button presents the odds offered by the player to the host at which point the host can choose to accept or reject the odds offered by the player. If the host rejects the offer by the player, then the player is presented with the original odds offered by the host.

In another embodiment, rather than making the odds field 503 an editable keystroke entry field, the player and host may communicate by other means, such as on a public communications page 700 or other type of bulletin board or message center, via direct email communications, or any other type of electronic communications. The odds can then be offered by the host as negotiated.

In some embodiments, the players homepage 400A or the game page 500 may comprise a forum button 404 in which clicking the forum button 404 takes the player to a public communications page 700, such as a chat room, a forum, a bulletin board, or other type of communications page in which a plurality of players can communicate publicly. At the public communications page 700, the players may communicate publicly with other players of the game as well as the host of the game. For example, the players may come to an agreement as a whole and negotiate with the host on the public communications page 700 for the desired odds. Once an agreement is reached, the host can input the negotiated odds in the game set up page 200B. The public communications page 700 may be a separate webpage or a pop up window within a current page.

In some embodiments, the forum button 404 on the players homepage 400A may display a list of hosts and the games offered by that host. The player can then select the desired host and game offered by the host with which the player may wish to enter negotiations individually or collectively with other players. In some embodiments, the forum button 404 may be placed on the game page 500. Clicking on the forum button 404 on the game page 500 will take the player to the public communications page 700 specifically for the game selected.

The game page 500 may also display a game link 502, which is a list of links to other similar types of games; a host link 504, which is a list of links of other types of games managed by the same host; and advertisements 114, 116, which the players can click on for credits and view advertisements.

The player may click on the advertisements to gain additional credits as well as information regarding the goods and/or services advertised. The advertisement 114, 116 may also have links to the vendor's website where more information can be found regarding the goods and/or services. A player may be limited to a predetermined number of times the player can click on a particular advertisement per day to receive credits. In some embodiments, the player may be limited to the amount of credits he can receive per day from clicks on advertisements. Thus, although the player may continue to click on and view advertisements, if the player has met his quota for credits received from advertisements, then the player will no longer receive credits. In lieu of receiving credits from advertisements, the player may borrow or purchase credits directly from the operator.

Once the player establishes sufficient credits to play a game, the player selects the particular event and submits the amount of credits he wants to wager in the wager entry field 501 by clicking a submit wager button 506. When the event ends, the wager is accounted. A player winning the game is credited according to his wager and the odds for that event.

The player may utilize the credits in several ways. The player may be given the option of redeeming his credits for a prize offered by the host. In some embodiments, if the credits are insufficient for a particular prize, the player may pay the remainder with money.

The player may also keep the credits and apply those credits towards other games managed by the host. The player simply conducts another search and selects the event managed by the same host.

The player may also redeem those credits with the operator for operator credits at a predetermined exchange rate to visit another host's game page. At the next host's game page, the player may re-convert the operator's credits back into playing credits at another predetermined exchange rate. The player may then play games hosted by a second host or purchase prizes sold by the second host.

The exchange rates are determined by the relative position of the hosts to the operator. The positions are determined by the operator based on various factors including, but not limited to, the wagering limits, the types of events, the odds of the events, and the types of prizes offered by the host. For example, a host offering games with favorable odds or inexpensive prizes may have a low exchange rate and receive less operator credits than the amount of his playing credits he is exchanging. Conversely, a second host offering poor odds or expensive prizes may have a high exchange rate and receive more operator credits than the amount of his playing credits he is exchanging.

In some embodiments, the hosts may choose to offer better exchange rates at their discretion. Thus, as an incentive to play a particular host's game, that host may offer beneficial exchange rates such that the player ends up with more credits than what the player entered the game with.

A player losing the game loses his wager. The host may contact the operator to receive authorization from the operator to send a communication to the player with an offer for a particular prize for purchase. At the host's discretion, the good or service may be offered at a discount. If the player still has credits remaining after the loss, the player can apply those credits to any purchase of the host's goods or services.

Figure 6:
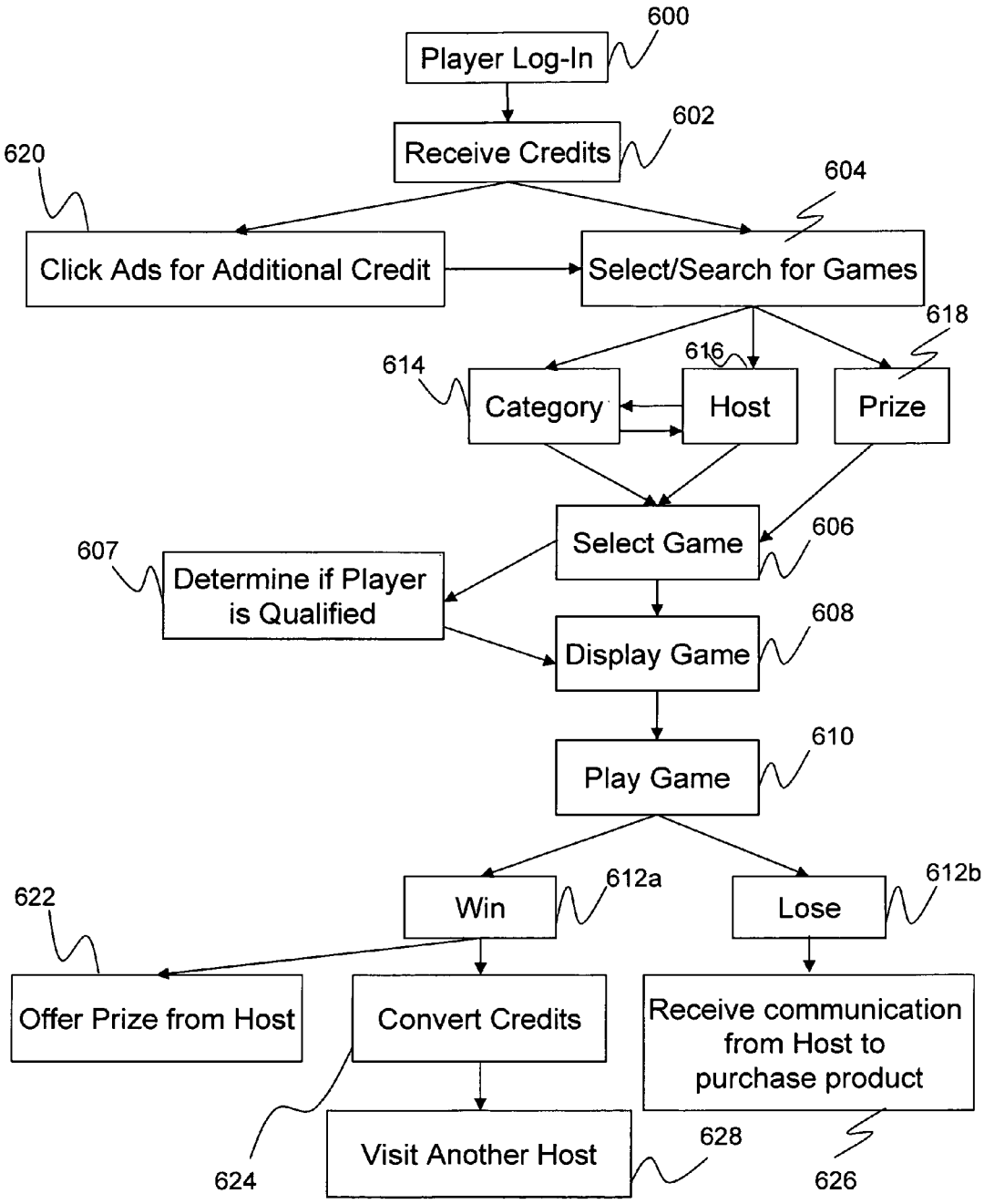
FIG. 6 is a flow diagram of the steps involved in playing a game.

Thus, as shown in the flow diagram in FIG. 6, the online gaming system funded by advertisements comprises providing a website operated by a server in communication with a network of computers and/or other electronic device; providing a webpage on the website for a player login 600 configured to automatically credit a player's account a first predetermined amount of credits 602 upon a player logging in; offering a selection of games from a predetermined list of games 604 for the player to play; receiving a choice of a game 606 for the player to play; displaying an interactive game page 608 in response to the receipt of the choice of a game, wherein the interactive game page displays an event, odds for an outcome of the event, a wagering field for each event, a rule of the game, and at least one advertisement; receiving a wager 610 for an event on the interactive game page; determining an outcome of the event 612*a*, 612*b*; and accounting for the wager based on the outcome of the event.

Additional features include determining whether a player is qualified to play the game 607, players searching or browsing for a game based on category 614, host 616, prize 618, vendors and other types of searching parameters; receiving additional credits for clicking on ads 620; being offered prizes from the host for winning a game 622; converting credits to operator's credits 624 to visit another host's game page; and receiving communications from a host for losing a game 626. Once credits are converted, the player can visit another host's website where his operator's credits are exchanged back into playing credits to play a game on the second host's game or purchase a prize from the second host's game 628.

This gaming website provides advertisers with another mode of advertising. Thus, advertiser's pay the operator advertisements costs as negotiated between the advertiser and operator, thereby funding the gaming website.

The gaming website comprises a server accessible by a client, either the host or the player, via a network of computers and/or other electronic devices that can communicate over a network or the internet, such as a mobile phone, smart phones, portable digital assistants, handheld computers, and other handheld devices or the like. The server receives all the data (i.e. any information posted or submitted by the host or player) from the client via standard input devices, such as keyboards, mouse, touch screens, microphones, or the like, and stores the data in a database for retrieval by another client in communication with the server. The server also requires a program for receiving, storing, sorting, retrieving, and delivering the data in accordance with the search feature as described herein. The server may also be in communications with other servers to request and receive the outcome and other statistical information relevant to a particular event. The server and any associated software can then account for the wagers received. The server also keeps track of the accounting for the players and the host. An accounting page may be presented to display all of the player's or host's activities on a display device, such as a monitor, so that the player or host can see the credits available, how many credits he has won or lost, when the transaction took place, what the transaction was for and other accounting information. The accounting page can also display a summary of the player's or host's activities.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of an online gaming system funded by advertisers in which hosts may host an online game, where the host selects the game, selects the advertiser who will advertise on its webpage, sets up the rules, and determines the odds; a player plays the game by wagering credits and can receive additional credits by clicking on advertisements, wherein winners can redeem their credits for prizes.

What is claimed is:

1. A method of providing an online gaming system funded by advertisements, comprising:

a. providing a website operated by a server in communication with a network;

b. providing a webpage on the website for a host login configured to automatically credit a host's account a first predetermined amount of credits upon a host logging in;

c. offering a selection of games from a predetermined list of games for the host to manage;

d. providing a game setup page in response to the selection of a game, the game setup page comprising at least one event to be wagered on, an odds entry field for the host to enter an odd for an outcome of the event, and a rules entry field for the host to enter a rule for the game;

e. offering a selection of advertisements to place in a predetermined number of general advertisement spaces;

f. crediting the host a second predetermined number of credits when a general advertisement is clicked on;

g. displaying an interactive game page;

h. receiving a wager for an event on the interactive game page;

i. determining the outcome of the event; and j. accounting for the wager based on the outcome of the event and the odds for the outcome of the event.

2. The method of claim 1, further comprising offering a host's advertisement space to upload a host's advertisement.

3. The method of claim 2, further comprising crediting the host a third predetermined number of credits when the host's advertisement is selected.

4. The method of claim 3, wherein the second predetermined number of credits is less than the third predetermined number of credits.

5. The method of claim 1, further comprising determining if the host is a qualified host; and displaying a link to the host's interactive game page in response to the determination that the host is the qualified host.

6. The method of claim 1, further comprising receiving a request to add a new game.

7. The method of claim 1, further comprising allowing the host to offer additional credits to a player.

8. The method of claim 1, further comprising privatizing the game to only allow a qualified player to play the game.

9. A method of providing an online gaming system funded by advertisements, comprising:

a. providing a website operated by a server in communication with a network;

b. providing a webpage on the website for a player login configured to automatically credit a player's account a first predetermined amount of credits upon a player logging in;

c. offering a selection of games from a predetermined list of games for the player to play;

d. receiving a choice of a game for the player to play;

e. displaying an interactive game page in response to the receipt of the choice of a game, wherein the interactive game page displays an event, odds for an outcome of the event, a wagering field for each event, a rule of the game, and at least one advertisement;

f. receiving a wager for an event on the interactive game page;

g. determining an outcome of the event; and h. accounting for the wager based on the outcome of the event.

10. The method of claim 9, further comprising providing a means for searching for a particular game.

11. The method of claim 10, further comprising a keyword search field.

12. The method of claim 11, wherein the predetermined list of games is generated in response to a search conducted based on a search criteria selected from the group consisting of a host, an event, a prize, an advertisement, and an advertiser.

13. The method of claim 9, further comprising crediting the player a second predetermined amount of credits for clicking on the at least one advertisement.

14. The method of claim 9, further comprising offering a prize for which the credit is redeemed.

15. The method of claim 14, further comprising directing a winner to an advertiser's website to redeem the credit for the prize.

16. The method of claim 9, further comprising offering the player an option to exchange the credit for an operator's currency at a first predetermined exchange rate.

17. The method of claim 16, further comprising converting the operator's currency into credit at a second predetermined exchange rate to be used by the player to play at a different game managed by a different host.

18. The method of claim 9, further comprising sending a communication to a losing player of the game to visit the host's website.

19. The method of claim 9, wherein the interactive game page displays a second selection of games similar to the choice of game selected by the player.

20. The method of claim 9, wherein the interactive game page displays a second selection of games managed by the host of the choice of game selected by the player.

21. The method of claim 9, further comprising providing a public communications page, wherein a communication can be posted by the player or a host and wherein the communication is viewable by any player or the host on the interactive game page and can be responded to by any player or the host on the interactive game page.

22. The method of claim 9, further comprising determining whether the player is qualified to play the game.

23. The method of claim 9, further comprising providing a means for the player to negotiate with a host.

24. The method of claim 23, wherein the negotiation is for the odds for the outcome of the event.

25. The method of claim 23, wherein the negotiation is for a cost of a prize.

26. A method of providing an online gaming system funded by advertisements, comprising:

a. providing a website for a host login configured to automatically credit a host's account a first predetermined amount of credits upon a host logging in;

b. offering a selection of games from a predetermined list of games for the host to manage;

c. receiving a choice of a game for the host to manage ("host's game");

d. providing a game setup page comprising at least one event to be wagered on, an odds entry field for the host to enter an odds for an outcome of the event, and a rules entry field for the host to enter a rule for the game;

e. offering a selection of advertisements to place in a plurality of advertisement spaces;

f. providing a player login on the website configured to automatically credit a player's account a second predetermined amount of credits upon a player logging in;

g. offering a selection of games from a predetermined list of games for the player to play;

h. receiving a selection of the host's game for the player to play;

i. displaying an interactive game page in response to the receipt of the selection of the host's game, wherein the interactive game page displays the event, the odds for the event, a wagering field for each event, a rule of the game, and at least one advertisement;

j. crediting the host a third predetermined amount of credits when the at least one advertisement is selected;

k. crediting the player a fourth predetermined number of credits when the at least one advertisement is selected;

l. receiving a wager from the player for an event on the interactive game page;

m. determining an outcome of the event; and n. accounting for the wager based on the outcome of the event and the odds for the outcome of the event.

27. The method of claim 26, further comprising offering the player an option to exchange the credit for an operator's currency at a first predetermined exchange rate.

* * * * *